US009058002B2

(12) United States Patent
Takagi et al.

(10) Patent No.: US 9,058,002 B2
(45) Date of Patent: Jun. 16, 2015

(54) IMAGE FORMING APPARATUS

(71) Applicants: Osamu Takagi, Nagoya (JP); Yuji Goto, Nagoya (JP)

(72) Inventors: Osamu Takagi, Nagoya (JP); Yuji Goto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/221,353

(22) Filed: Mar. 21, 2014

(65) Prior Publication Data

US 2014/0286652 A1 Sep. 25, 2014

(30) Foreign Application Priority Data

Mar. 22, 2013 (JP) ..... 2013-060094

(51) Int. Cl.
*G03G 15/00* (2006.01)
*G03G 15/01* (2006.01)

(52) U.S. Cl.
CPC ..... *G03G 15/5054* (2013.01); *G03G 15/0189* (2013.01)

(58) Field of Classification Search
CPC ..... G03G 15/5054; G03G 15/0189
USPC ..... 399/13, 411
See application file for complete search history.

(56) References Cited

U.S. PATENT DOCUMENTS 7,809,289 B2 * 10/2010 Dan ..... 399/13
7,933,531 B2 4/2011 Hayakawa
8,208,826 B2 * 6/2012 Takahashi ..... 399/74
2009/0169233 A1 7/2009 Hayakawa
2012/0076527 A1 3/2012 Goto

FOREIGN PATENT DOCUMENTS

JP 2002-040743 A 2/2002
JP 2002-131997 A 5/2002
JP 2002131997 A * 5/2002 ..... G03G 15/00
JP 2005024459 A 1/2005
JP 2009-157206 A 7/2009
JP 2010-186143 A 8/2010
JP 2012-073491 A 4/2012

OTHER PUBLICATIONS

Co-pending U.S. Appl. No. 14/221,348, filed Mar. 21, 2014.
Mar. 6, 2015—(US) Final Office Action—U.S. Appl. No. 14/221,348.

* cited by examiner

*Primary Examiner* — Billy Lactaoen
(74) *Attorney, Agent, or Firm* — Banner & Witcoff, Ltd.

(57) ABSTRACT

An image forming apparatus includes a belt unit detachable from a main body, a sensor unit, a blocking member, a moving mechanism, and a determination portion. The sensor unit includes a light emitting element configured to emit an outgoing light toward the belt, a first light receiving element configured to output a first signal, and a second light receiving element. The blocking member includes a first window and a second window. The moving mechanism is configured to move the blocking member between a first position in which the outgoing light passes the first window and a second position in which the outgoing light passes through the second window. The determination portion is configured to, when the blocking member is in the second position, determine whether the belt unit is attached to the main body based on the first signal output from the first light receiving element.

9 Claims, 8 Drawing Sheets

IMAGE FORMING APPARATUS

CROSS REFERENCE TO RELATED APPLICATION

This application claims priority from Japanese Patent Application No. 2013-060094, filed on Mar. 22, 2013, which is incorporated herein by reference in its entirety.

TECHNICAL FIELD

Aspects of the disclosure relate to an image forming apparatus including a detachable belt unit.

BACKGROUND

A known image forming apparatus includes a bet unit and a developer density sensor for detecting a density of a developer transferred onto a belt. In the image forming apparatus, the developer density sensor is also used for determining whether the belt unit is attached to a main body.

The determination whether the belt unit is attached to the main body is made by a light receiving element when the light receiving element receives light emitted from a light emitting element and reflected from the belt.

SUMMARY

However, the light reflected from the belt may include other light such as light from the lighting installed near the image forming apparatus, in addition to the light emitted from the light emitting element. When receiving the other light, the light receiving element may improperly determine that the belt unit is attached to the main body although the belt unit is not actually attached to the main body.

Illustrative aspects of the disclosure provide an image forming apparatus including a detachable belt unit and configured to reduce the potential for an improper determination as to whether the belt unit is attached to the image forming apparatus.

According to an aspect of the disclosure, an image forming apparatus includes a main body, a belt unit configured to be attached to and removed from the main body and including a belt, a sensor unit, a blocking member, a moving mechanism, and a determination portion. The sensor unit includes a light emitting element configured to emit an outgoing light toward the belt, a first light receiving element configured to receive a first incoming light and to output a first signal, and a second light receiving element configured to receive a second incoming light and to output a second signal. The blocking member is configured to cover the sensor unit and move relative to the sensor unit. The blocking member includes a first window configured to allow the outgoing light, the first incoming light and the second incoming light to pass through the first window, and a second window configured to allow the outgoing light and the first incoming light to pass through the second window. The second window is smaller in size than the first window. The moving mechanism is configured to move the blocking member between a first position in which the outgoing light emitted from the light emitting element passes through the first window and a second position in which the outgoing light emitted from the light emitting element passes through the second window. The determination portion is configured to, when the blocking member is in the second position, determine whether the belt unit is attached to the main body based on the first signal output from the first light receiving element, the first signal indicating that the first light receiving element receives the first incoming light.

With this structure, the determination portion determines whether the belt unit is attached to the main body when the blocking member is in the second position. As the second window is smaller in size than the first wall, the second wall reduces the potential for the other light received by the first light receiving element compared with the first window. Thus, this structure can reduce the potential for an improper determination as to whether the belt unit is attached.

BRIEF DESCRIPTION OF THE DRAWINGS

Illustrative aspects will be described in detail with reference to the following figures in which like elements are labeled with like numbers and in which.

DETAILED DESCRIPTION

The following description is directed to an illustrative embodiment of the disclosure. An electrophotographic image forming apparatus according to illustrative aspects of the disclosure will be described with reference to accompanying drawings.

Arrows indicating directions in each drawing are indicated to facilitate the understanding of positional relationships among components. For portions or components with numerals, at least one is provided unless "plural" or "two or more" is specifically stated otherwise.

Figure 1:
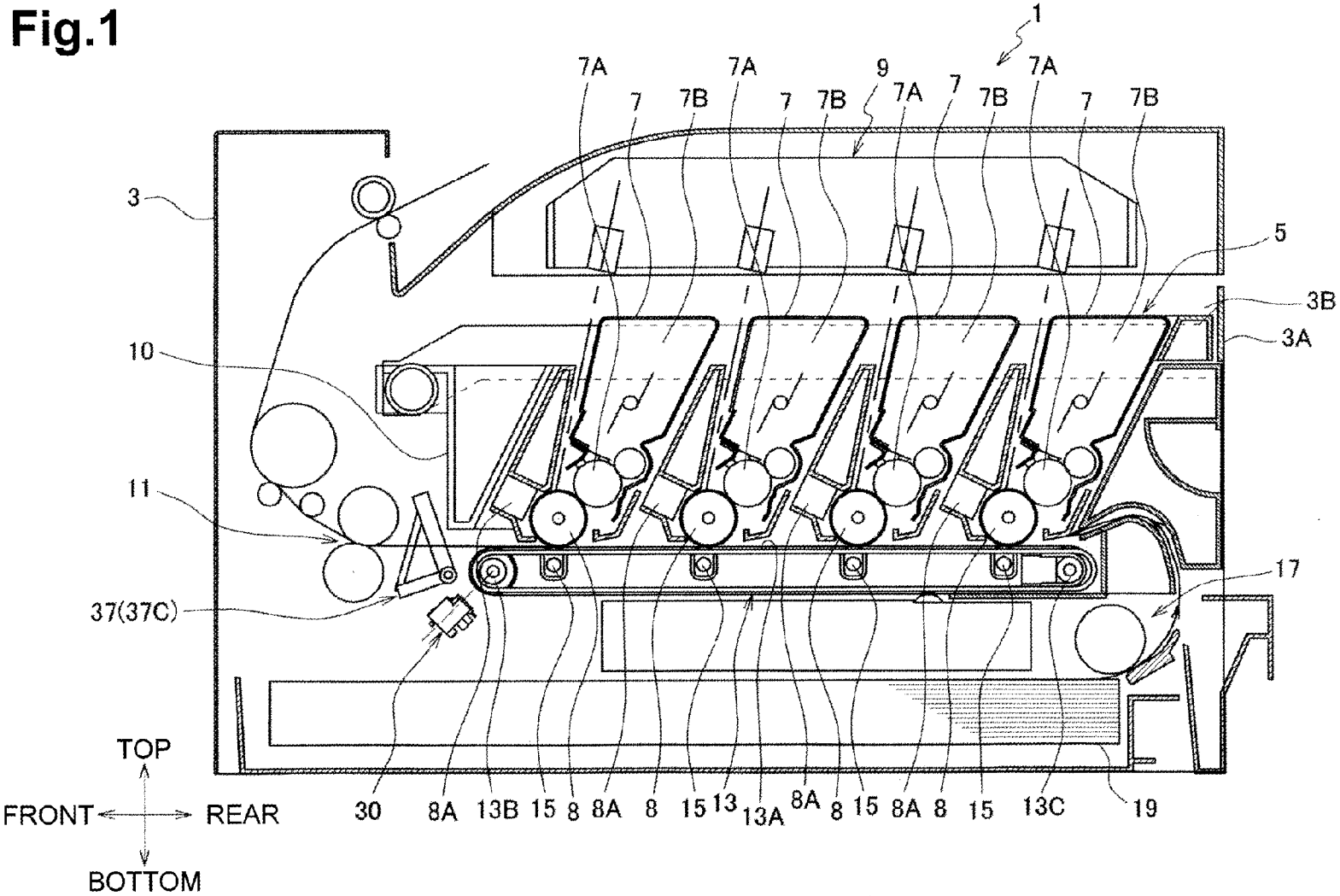
FIG. 1 is a cross-sectional view of an illustrative image forming apparatus according to an embodiment of the disclosure.

As shown in FIG. 1, an image forming apparatus 1 includes, in a casing 3, an image forming portion 5, light exposure units 9, and a fixing unit 11. The image forming portion 5 includes developing cartridges 7, photosensitive drums 8 and chargers 8A.

Each of the process cartridges 7 includes a developing roller 7A, a storing portion 7B. The developing rollers 7A are disposed such that their axes are parallel to each other. The photosensitive drums 8 are disposed in correspondence with the developing rollers 7A.

Each of the photosensitive drums 8 is configured to carry a developer image. Each of the chargers 8A is configured to charge a corresponding one of the photosensitive drums 8. Each of the exposure units 9 is configured to expose a corresponding one of the charged photosensitive drums 8 to light such that an electrostatic latent image is formed on the photosensitive drum 8. Each of the developing rollers 7A is configured to supply developer stored in the storing portion 7B to a corresponding one of the photosensitive drums 8 to form a developer image corresponding to the electrostatic latent image.

Each developing cartridge 7 is detachably attached to a drawer 10. The drawer 10 is movable with respect to the main body and attached to the main body. The casing 3 is provided with a cover 3A, which is configured to open and close an opening 3B and disposed on an end in a direction in which the drawer 10 moves. The opening 3B is an opening through which the drawer 10 is moved in and out of the main body or the casing 3.

When the drawer 10 is pulled out toward the front side with respect to the main body, the developing cartridges 7 are to be detachable from the main body and the drawer 10. As the developing cartridges 7 are to be detachable when the drawer 10 is pulled out, the drawer 10 is included in the image forming unit 5 in this embodiment.

The main body is referred to as a portion such as main frames which are not attached to or replaced from the image forming apparatus by a user. The main frames are reinforcing members each shaped in a plate and disposed on both sides of the drawer 10 such that the main frames sandwich the drawer 10.

A belt 13A is endless and extends between a drive roller 13B and a driven roller 13C. The belt 13A, the drive roller 13B and the driven roller 13C are united in a frame (not shown) and make up a belt unit 13. The belt unit 13 is detachably attached to the main body.

A surface (hereinafter referred to as a transfer surface) of the belt 13A facing the photosensitive drums 8 is configured to feed a sheet toward the fixing unit 11 while moving from the driven roller 13C toward the drive roller 13B. Transfer rollers 15 are disposed in correspondence with the photosensitive drums 8 such that the belt 13A is sandwiched between the transfer rollers 15 and the corresponding photosensitive drums 8.

The transfer rollers 15 are configured to each transfer the developer image carried on the corresponding photosensitive drum 8 to a sheet received on the transfer surface of the belt 13A. The developer images on the photosensitive drums 8 are overlaid on the sheet. The fixing unit 11 is configured to heat the developer images and fix them to the sheet.

A feeder 17 is disposed upstream of the belt 13A in a sheet feed direction in which the sheet is fed. The feeder 17 is configured to separate a sheet from sheets supported on a sheet supply tray 19 and feed the sheet toward the image forming portion 5. The sheet supply tray 19 is configured to support sheets on which images are to be formed and be detachably attached to the main body.

A sensor unit 30 may be disposed such that the sensor unit 30 faces one of the drive roller 13B and the driven roller 13C. In this embodiment, the sensor unit 30 is disposed facing the drive roller 13B.

Figure 2B:
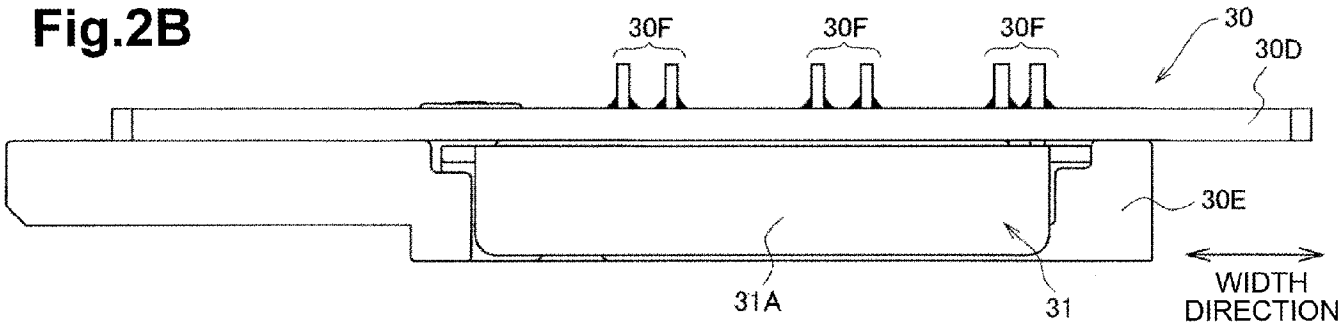
FIG. 2B is a front view of the sensor unit.
Figure 2A:
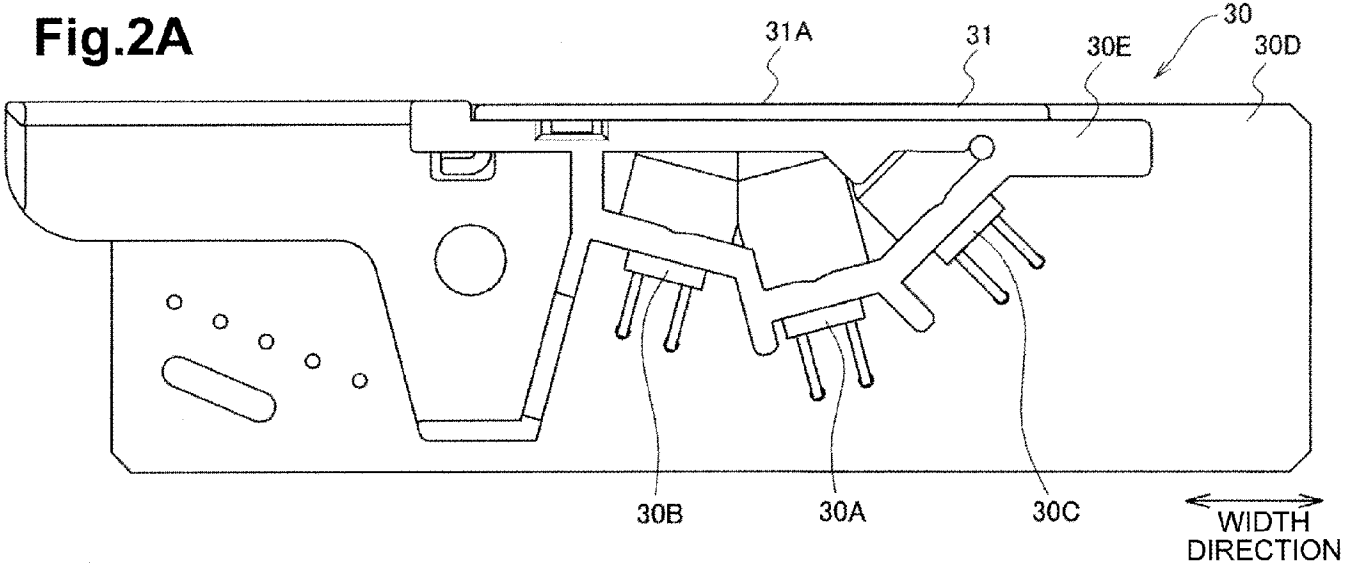
FIG. 2A is a bottom view of a sensor unit.

As shown in FIG. 2A, the sensor unit 30 is a combination of a light emitting element 30A, a first light receiving element 30B, and a second light receiving element 30C through a circuit board 30D. Specifically, as shown in FIG. 2B, leads 30F of the first light emitting element 30A, the first light emitting element 30B and the second light receiving element 30C are inserted into through holes drilled in the circuit board 30D by through-hole technology.

The light emitting element 30A is configured to emit light toward the belt 13A. Specifically, the light emitting element 30A is configured to emit light toward patch marks (not shown) formed on the belt 13A. The first light receiving element 30B is configured to receive light regularly reflected from the belt 13A and to output a signal indicating an intensity of the light. The second light receiving element 30C is configured to receive light diffusely reflected from the belt 13A and to output a signal indicating an intensity of the light. The light regularly reflected is light reflected from the belt 13A at an angle of reflection which is equal to an angle of incidence for light emitted toward the belt 13A. The light diffusely reflected is reflected light other than the light regularly reflected.

The patch marks are developer images transferred onto the belt 13A for determining an amount to correct displacement and density of overlaid developer images transferred onto a sheet. A controller 40 is configured to control the image forming portion 5 and the exposure units 9. The controller 40 is configured to control operation to correct the exposure units 9 as necessary based on a signal emitted from the sensor unit 30.

The sensor unit 30 is assembled with a holder 30E made of resin. Specifically, the light emitting element 30A, the first light receiving element 30B, and the second light receiving element 30C are held in holes (not shown) formed in the holder 30C.

The light emitting element 30A, the first light receiving element 30B, and the second light receiving element 30C are arranged in a direction parallel to an axis of the drive roller 13B (hereinafter referred to as a width direction). A light emitting side of the light emitting element 30A and a light receiving side of each of the first light receiving element 30B and the second light receiving element 30C are covered by a translucent cover 31.

A portion of the translucent cover 31 facing the belt 13A includes a light transmission portion 31A in which light can be transmitted. The light transmission portion 31A is colorless or color transparent to cover the light emitting side of the light emitting element 30A and the light receiving side of the first light receiving element 30B and the second light receiving element 30C.

Figure 3:
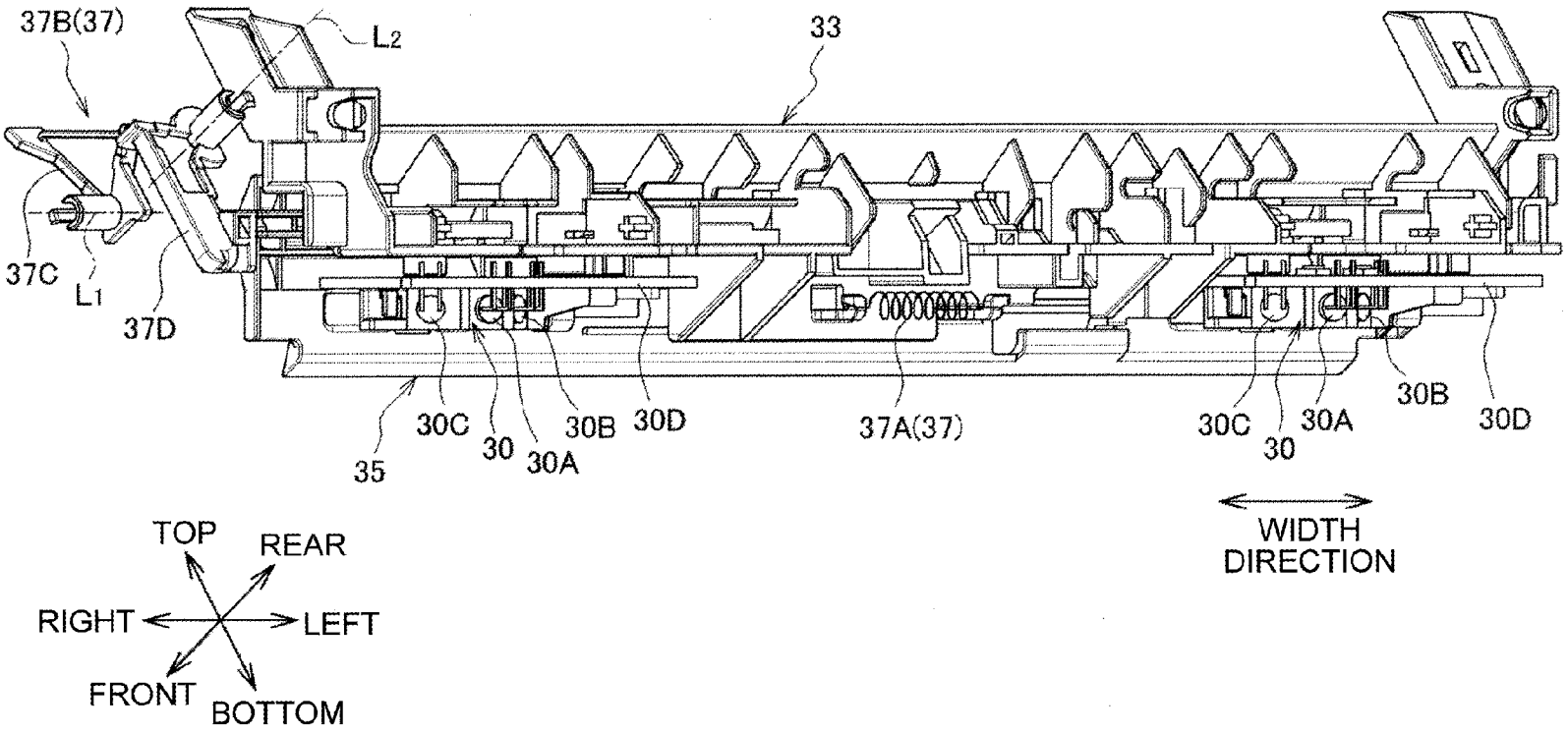
FIG. 3 illustrates a base frame, a moving mechanism and a blocking member.

The sensor unit 30 is attached to a base frame 33 shown in FIG. 3. The base frame 33 is a beam-like member extending in the width direction. In the embodiment, two sensor units 30, which are identical in structure, are assembled to the base frame 33 at end portions thereof in a longitudinal direction thereof.

Figure 4:
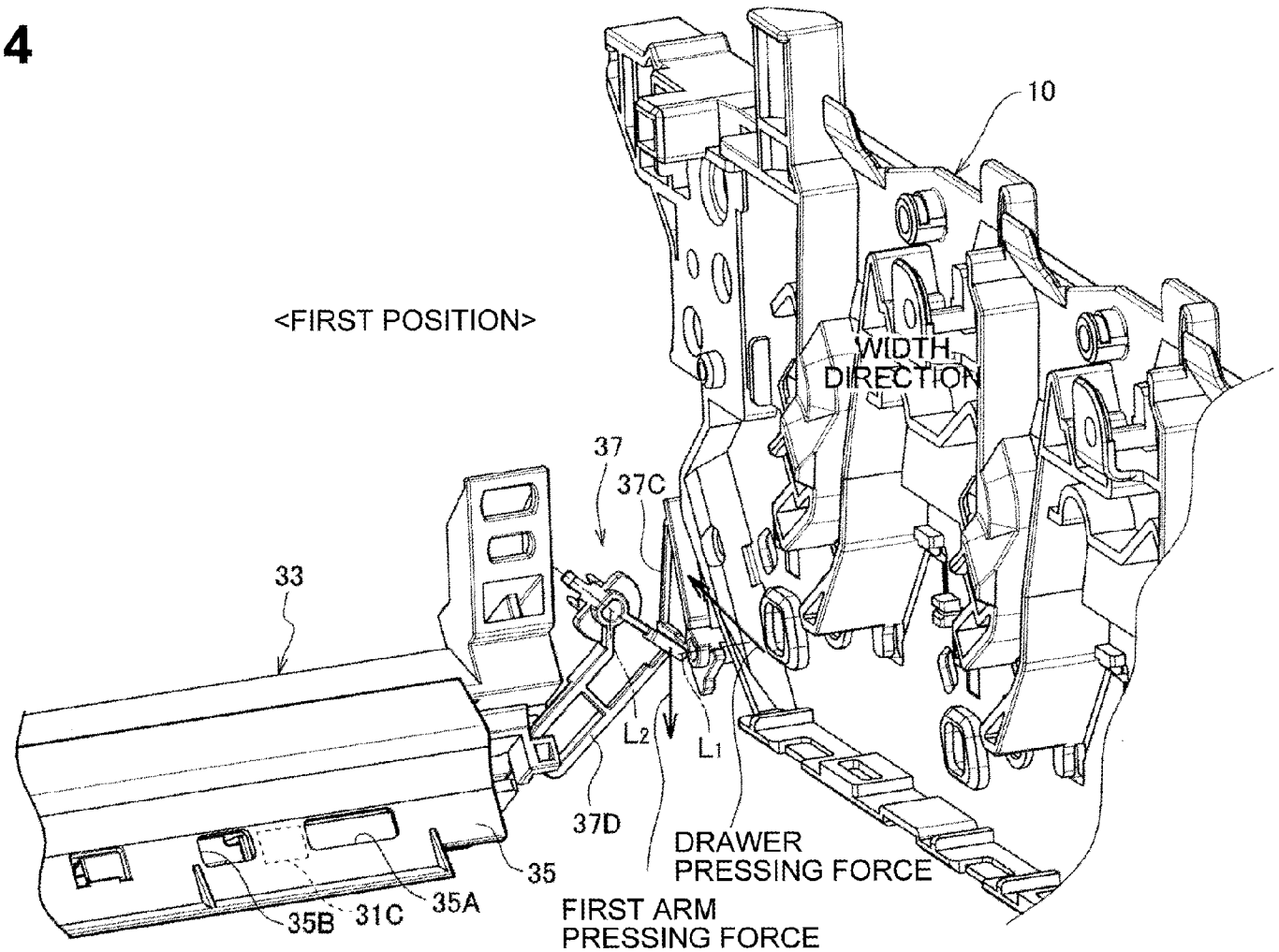
FIG. 4 illustrates positional relationship among the base frame, the moving mechanism and the blocking member relative to a drawer.

As shown in FIG. 4, the base frame 33 is disposed between the main frames making up the main body and each end of the base frame 33 in its longitudinal direction is directly or indirectly attached to a corresponding one of the main frames.

Figure 5:
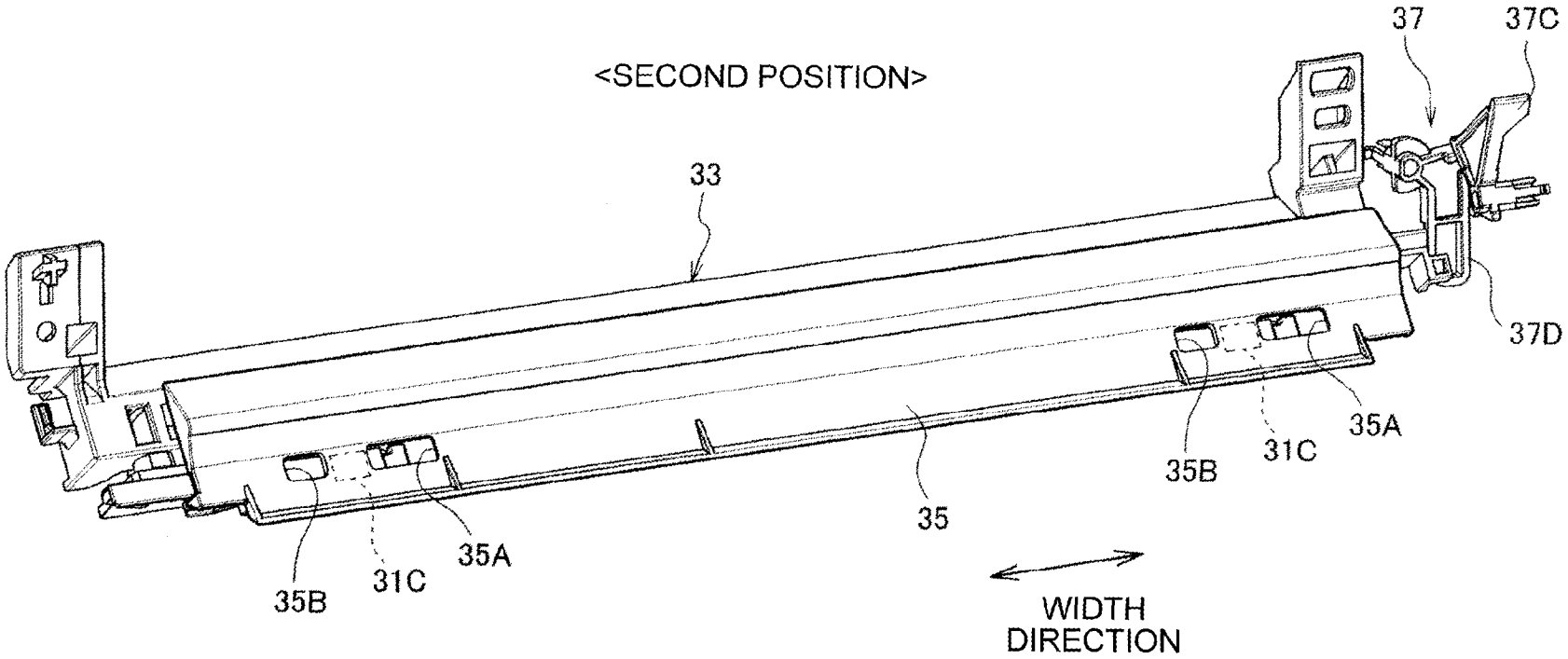
FIG. 5 illustrates the base frame, the moving mechanism, and the blocking member.

As shown in FIG. 5, a blocking member 35 is assembled to the base frame 33. The blocking member 35 has first windows 35A and second windows 35B. In FIG. 5, an outline of the blocking member 35 is shown thicker than other portions.

The blocking member 35 is configured to move with respect to the sensor units 30 attached to the base frame 33. The first windows 35A and the second windows 35B are arranged in a moving direction in which the blocking member 35 moves. The moving direction of the blocking member 35 is parallel to the longitudinal direction of the base frame 33 or the width direction.

Each of the first windows 35A is an opening through which light can pass such as an outgoing light emitted from the light emitting element 30A, a first incoming light received by the first light receiving element 30B and a second incoming light received by the second light receiving element 30C. Each of the second windows 35B is an opening through which the outgoing light and the first incoming light can pass. The second windows 35B are smaller in size than the first windows 35A.

Figure 6:
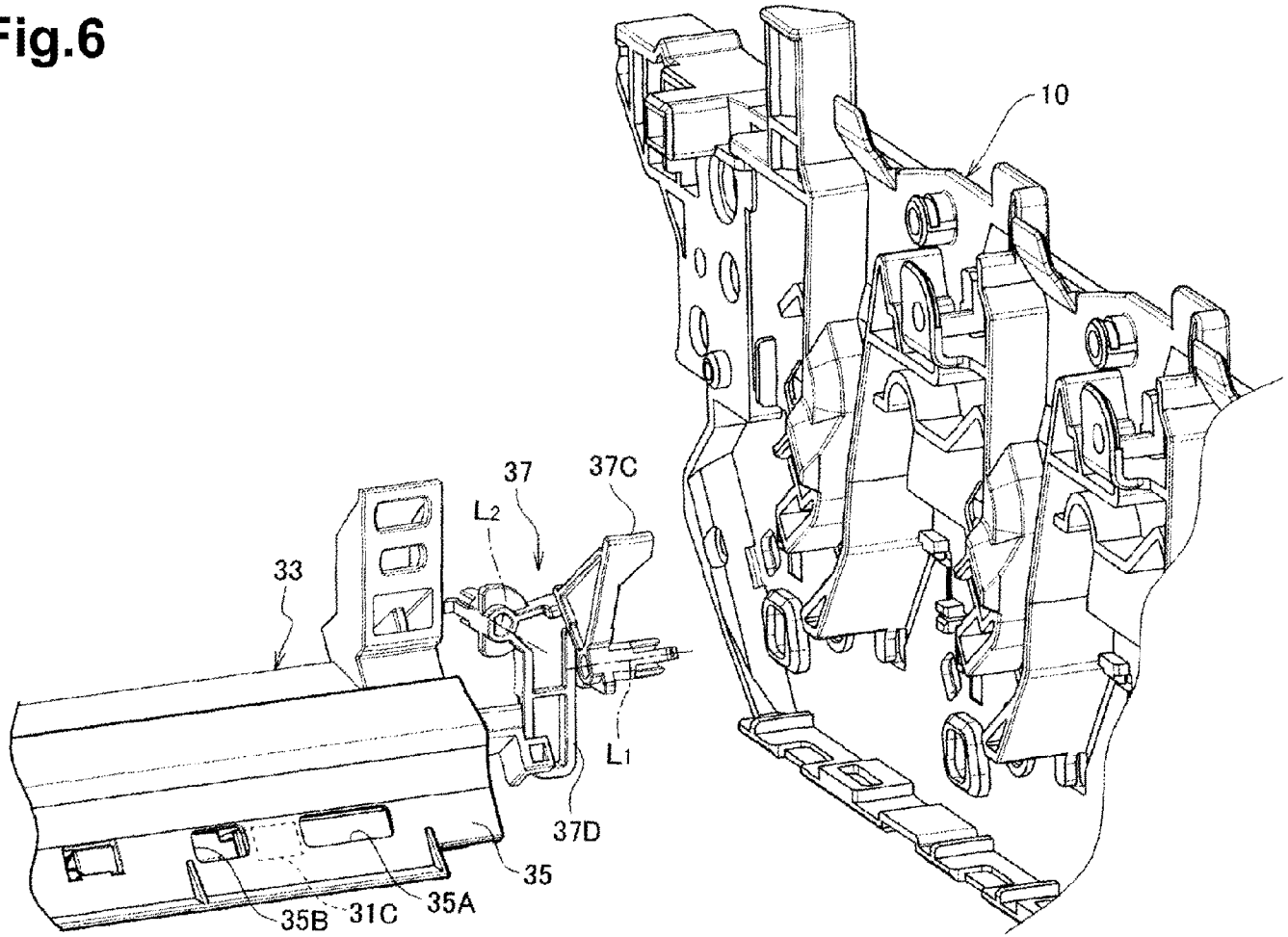
FIG. 6 illustrates positional relationship among the base frame, the moving mechanism and the blocking member relative to the drawer.

The moving mechanism 37 is configured to move the blocking member 35 between a first position and a second position. The first position is a position shown in FIG. 4 where the blocking member 35 is located such that the outgoing light passes through the first window 35A. The second position is a position shown in FIG. 6 where the blocking member 35 is located such that the outgoing light passes through the second window 35B.

When the blocking member 35 is in the first position, the first incoming light and the second incoming light can be received at each sensor unit 30 and the second incoming light cannot be received at each sensor unit 30.

Cleaning members 31C are fixed to or integrally formed with portions of the blocking member 35 facing the translucent covers 31. The cleaning members 31C are configured to slidingly contact the corresponding translucent covers 31. Thus, when the blocking member 35 moves, the translucent portions 31A are wiped by the cleaning members 31C.

Each cleaning member 31C is disposed between the first window 35A and the second window 35B. When the blocking member 35 moves from the second position to the first position, each cleaning member 31 wipes portions of the translucent portion 31A corresponding to the light emitting element 30A, the first light receiving element 30B and the second light receiving element 30C. The cleaning members 31C are made of elastically deformable porous material such as sponge. The cleaning members 31C contact the translucent portions 31A in compressed and deformed state.

As shown in FIG. 3, the moving mechanism 37 includes a spring 37A and an operation portion 37B. The spring 37A is configured to exert an elastic force to cause the blocking member 35 to move from the first position to the second position. In this embodiment, the spring 37A is a tension coil spring of which one end, in a direction the spring 37A extends, is connected to the base frame 33 and the other end is connected to the blocking member 35.

The operation portion 37B is configured to exert, on the blocking member 35, a force against the elastic force of the spring 37A, namely a force to move the blocking member 35 from the second position to the first position. Specifically, the operation portion 37B includes a first arm 37C and a second arm 37D, which are supported directly or indirectly by the main body such that the first arm 37C and the second arm 37D are pivotable.

A pivot axis L1 of the first arm 37C and a pivot axis L2 of the second arm 37D are not parallel to each other. The pivot axis L1 of the first arm 37C extends in a horizontal direction perpendicular to the direction in which the drawer 10 moves or in a direction parallel to the direction in which the blocking member 35 moves. The pivot axis L2 of the second arm 37D extends in a direction parallel to the direction in which the drawer 10 moves.

When the image forming unit 5 or the drawer 10 is attached to the main body as shown in FIG. 1, the first arm 37C is pressed by the drawer 10 and pivots in a direction in which the drawer 10 is attached, that is, rearward.

When the first arm 37C pivots in the direction in which the drawer 10 is attached, the second arm 37D is pressed by the first arm 37C as shown in FIG. 4. The second arm 37D pivots in a direction in which its end moves toward the blocking member 35, and presses the blocking member 35 from the second position toward the first position.

When the drawer 10 is attached to the main body, the operation portion 37B is pressed by the drawer to apply the opposing force against the spring 37A to the blocking member 35 and move the blocking member 35 to the first position. Thus, when the drawer 10 is pulled out from the main body, the opposing force disappears, and the elastic force of the spring 37A causes the blocking member 35 to move from the first position to the second position.

As apparent from the above description, when the blocking member 35 is in the first position, the drawer 10 is attached to the main body. In other words, when the drawer 10 is attached to the main body and the cover 3A is closed, the moving mechanism 37 holds the blocking member 35 in the first position. Thus, the first position is also referred to as an attached position.

When the cover 3A is open and the drawer 10 is pulled out from the main body, the blocking member 35 is disposed in the second position. Thus, the second position is also referred to as an unattached position.

In the embodiment, when the blocking member 35 is in the unattached position, the controller 40 (FIG. 7) determines whether the belt unit 13 is attached to the main body based on a signal output from the first light receiving element 30B indicating that the first light receiving element 30B receives light.

Figure 7:
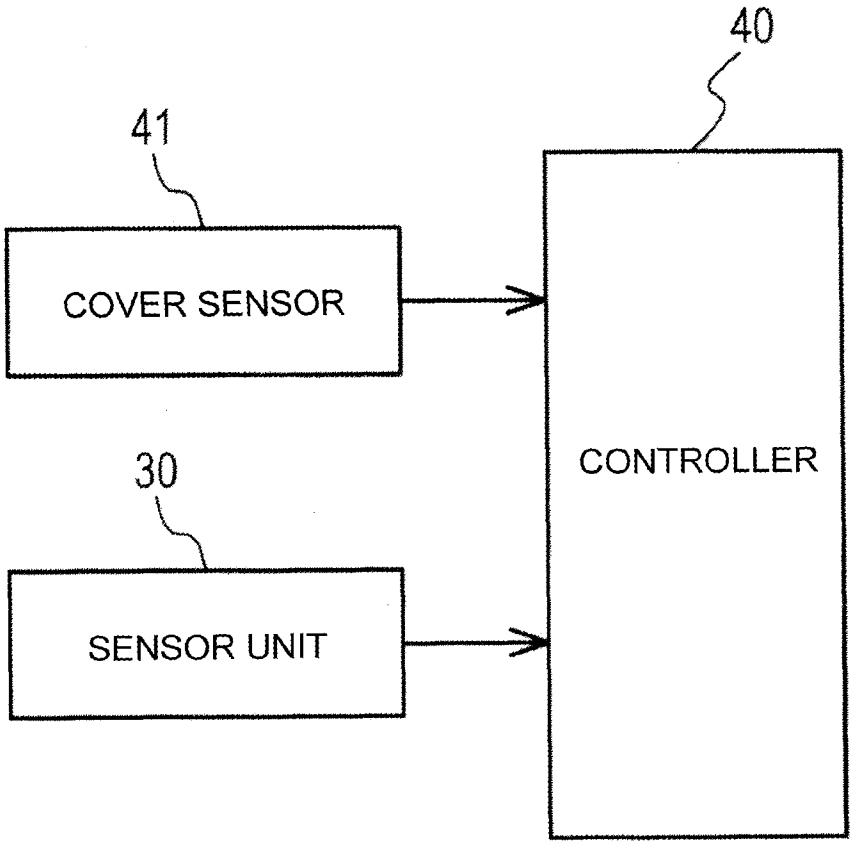
FIG. 7 is a block diagram of a control system.

The controller 40 shown in FIG. 7 is configured to make the above determination, that is, the determination as to whether the belt unit is attached. The controller 40 is basically a microcomputer including the CPU, the ROM and the RAM and constitutes a determination portion configured to perform the above determination.

The controller 40 receives signals from a cover sensor 41, the first light receiving element 30B and the second light receiving element 30C. The cover sensor 41 is configured to determine as to whether the cover 3A is open. The controller 40 also controls the operation of the light emitting element 30A.

Figure 8:
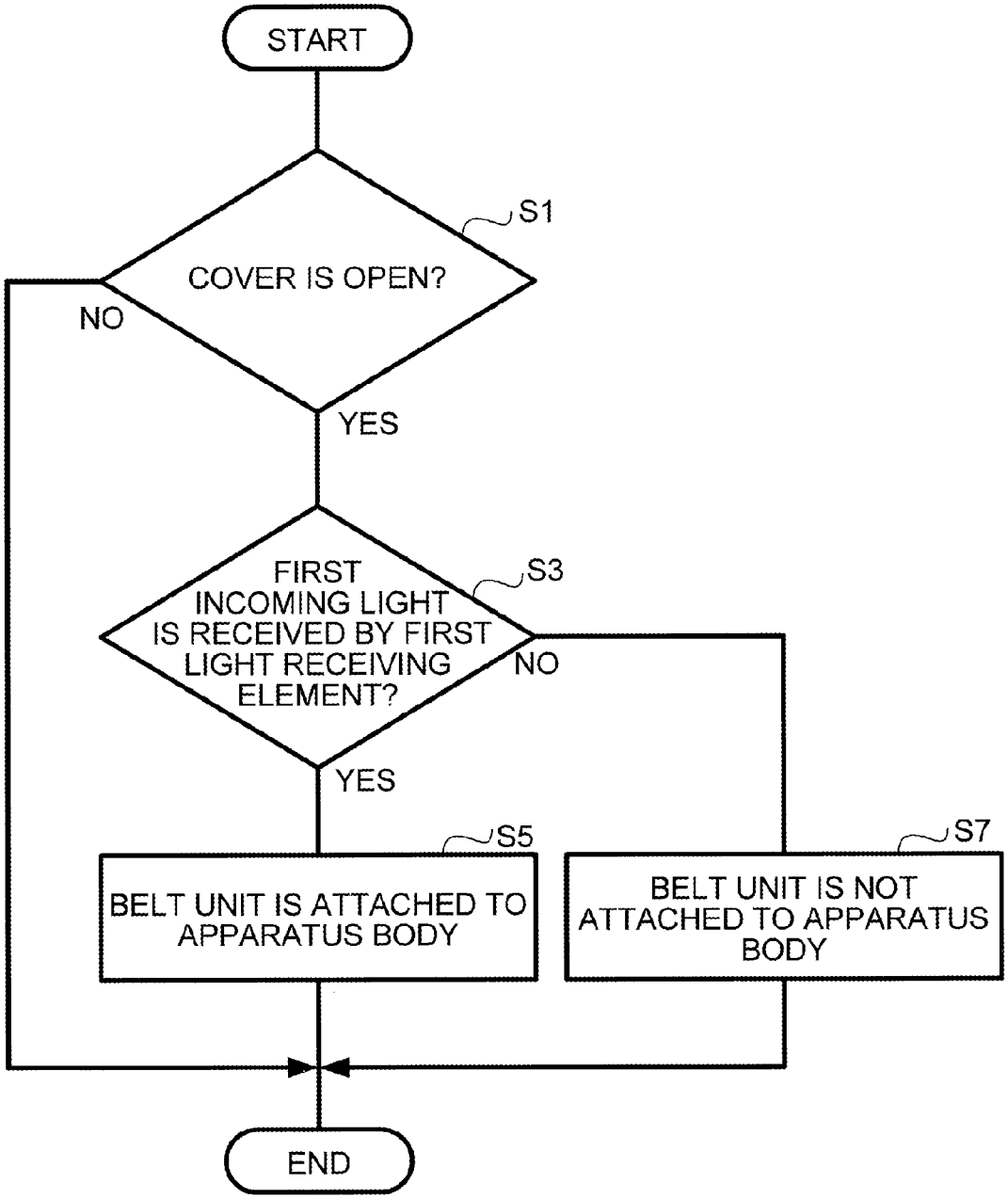
FIG. 8 is a flowchart of a controller.

The controller 40 or the CPU determines whether the belt unit is attached in accordance with programs previously stored in a nonvolatile storing portion such as the ROM. FIG. 8 is a flowchart illustrating a control operation (hereinafter referred to as the control) of the controller 40 for determining whether the belt unit is attached.

When the power of the image forming apparatus 1 is turned on, the controller 40 starts a main control for controlling the entire of the image forming apparatus 1. The control is regularly started or performed by the controller 40 as an interrupt during the main control in action.

Programs for performing the main control are also stored in the nonvolatile storing portion and performed by the controller 40. When the power is shut down, the main control and the control stop.

When the control is started, the controller 40 determines whether the cover 3A is open based on a signal from the cover sensor 41 (S1). When the controller 40 determines that the cover 3A is not open (S1: No), the control ends.

When the controller 40 determines that the cover 3A is open (S1: Yes), it determines whether the first incoming light is received by the first light receiving element 30B (S3). When the controller 40 determines that the first incoming light is received by the first light receiving element 30B (S3: Yes), it determines that the belt unit 13 is attached to the main body (S5).

When the controller 40 does not determine that the first incoming light is received by the first light receiving element 30B (S3: No), it determines that the belt unit 13 is not attached to the main body (S7). When the determinations at S5 and S7 end, the control ends.

When the controller 40 determines that the belt unit 13 is not attached to the main body (S7), it notifies a user that the belt unit 13 is not attached to the main body by using a display or an alarm lamp, and stops the image forming process or shifts to a mode which is not executable.

When the drawer 10 is pulled out from the main body or the blocking member 35 is in the unattached position (the second position), the cover 3A is open. When the cover 3A is closed, the blocking member 35 is in the attached position (the first position).

In the embodiment, when the cover 3A is open, the controller 40 assumes that the blocking member 35 is in the unattached position (the second position), and performs the determination as to whether the belt unit is attached.

In the embodiment, the controller 40 performs the determination as to whether the belt unit is attached is made when the cover 3A is open. Thus, the determination is made also when the blocking member 35 is in the attached position (the first position).

As described above, the cover 3A is open when the blocking member 35 is in the unattached position (the second position). Thus, it is not a practical problem that, when the cover 3A is open, the controller 40 assumes that the blocking member 35 is in the unattached position (the second position) and performs the determination as to whether the belt unit is attached.

In the embodiment, at least when the blocking member 35 is in the unattached position (the second position), the determination as to whether the belt unit is attached is performed. As the second window 35B is smaller than the first window 35A, the second window 35B reduces the potential for the other light received by the first light receiving element 30B compared with the first window 35A. Thus, this structure can reduce the potential for an improper determination as to whether the belt unit is attached.

The operation portion 37B is configured to exert the opposing force on the blocking member 35 when pressed by the image forming unit 5 or the drawer 10 attached to the main body.

In other words, the blocking member 35 is configured to move between the attached position (the first position) and the unattached position (the second position) in response to attachment or detachment of the image forming unit 5 or the drawer 10. When the image forming unit 5 is attached to the main body, the blocking member 35 is in the attached position (the first position). When the image forming unit 5 is detached from the main body, the blocking member 35 is in the unattached position (the second position).

In the embodiment, the image forming apparatus 1 includes the translucent covers 31 and the cleaning members 31C. The translucent covers 31 each cover the light emitting element 30A, the first light receiving element 30B and the second light receiving element 30C and are each configured to pass light therethrough. The cleaning members 31C are fixed to the portions of the blocking member 35 corresponding to the translucent covers 31 and configured to wipe the translucent covers 31.

In the embodiment, this structure allows the translucent covers 31 to be wiped in response to attachment or detachment of the image forming unit 5 or the drawer 10. In other words, the embodiment does not need an actuator such as a solenoid for moving the cleaning members 31C.

In the embodiment, the first light receiving element 30B is configured to mainly receive light regularly reflected from the belt 13A. The second light receiving element 30C is configured to mainly receive light diffusely reflected from the belt 13A.

Thus, the determination as to whether the belt unit is attached is performed mainly based on the light regularly reflected from the belt 13A. Compared with the determination based on the light diffusely reflected from the belt 13A, this structure can reduce the potential for an improper determination as to whether the belt unit is attached due to the other light.

The embodiment shows, but is not limited to that the image forming apparatus 1 is a direct transfer type in which the developer images carried on the photosensitive drums 8 are directly transferred onto a sheet. For example, the image forming apparatus 1 may be an intermediate transfer type in which developer images carried on the photosensitive drums are transferred onto the belt 13A and then the developer images on the belt 13A are transferred onto a sheet.

The embodiment shows, but is not limited to that, when the cover 3A is open, the controller 40 assumes that the blocking member 35 is in the unattached position (the second position) and performs the determination as to whether the belt unit is attached.

For example, the controller 40 may make a determination whether the blocking member 35 is in the unattached position (the second position). When the controller 40 determines that the blocking member 35 is in the unattached position, the controller 40 may perform the determination as to whether the belt unit is attached.

The determination as to whether the blocking member 35 is in the unattached position (the second position) may be made based on whether the second light receiving element 30C receives a second incoming light, for example.

The embodiment shows, but is not limited to that the first window 35A and the second window 35B are through holes. At least one of the first window 35A and the second window 35B may be made by a translucent material.

The embodiment shows, but is not limited to that the cleaning member 31C is fixed to a portion of the blocking member 35 disposed between the first window 35A and the second window 35B. The cleaning member 31C may be omitted or disposed in a different position except for the portion of the blocking member 35.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body;

a belt unit configured to be attached to and removed from the main body, the belt unit including a belt;

a sensor unit including:

a light emitting element configured to emit an outgoing light toward the belt;

a first light receiving element configured to receive a first incoming light and to output a first signal; and a second light receiving element configured to receive a second incoming light and to output a second signal;

a blocking member configured to move relative to the sensor unit, the blocking member including:

a first window configured to allow the outgoing light, the first incoming light and the second incoming light to pass through the first window; and, a second window configured to allow the outgoing light and the first incoming light to pass through the second window, the second window being smaller in size than the first window;

a moving mechanism configured to move the blocking member between a first position in which the outgoing light emitted from the light emitting element passes through the first window and a second position in which the outgoing light emitted from the light emitting element passes through the second window; and a determination portion configured to, when the blocking member is in the second position, determine whether the belt unit is attached to the main body based on the first signal output from the first light receiving element, the first signal indicating that the first light receiving element receives the first incoming light.

2. The image forming apparatus according to claim 1, wherein the first window is a through hole formed in the blocking member.

3. The image forming apparatus according to claim 2, wherein the second window is a through hole formed in the blocking member.

4. The image forming apparatus according to claim 1, further comprising a cover configured to move between a closed position in which an opening of the main body is closed and an open position in which the opening is open, wherein the moving mechanism is configured to, when the cover is in the closed position, hold the blocking member in the first position.

5. The image forming apparatus according to claim 1, wherein the moving mechanism includes:

a spring configured to exert an elastic force on the blocking member such that the blocking member moves from the first position to the second position; and an operation portion configured to exert, on the blocking member, a force against the elastic force of the spring.

6. The image forming apparatus according to claim 5, further comprising an image forming unit detachably attached to the main body and configured to form an image on a sheet, wherein the operation portion of the moving mechanism is configured such that, when the image forming unit is attached to the main body, the operation portion is pressed by the image forming unit and exerts the force against the elastic force of the spring on the blocking member.

7. The image forming apparatus according to claim 1, further comprising:

a translucent cover configured to allow light to pass therethrough and cover the light emitting element, the first light receiving element, and the second light receiving element; and a cleaning member fixed to a portion of the blocking member facing the translucent cover and configured to wipe the translucent cover.

8. The image forming apparatus according to claim 7, wherein the cleaning member is disposed between the first window and the second window.

9. The image forming apparatus according to claim 1, wherein the first light receiving element is configured to receive the first incoming light regularly reflected from the belt, and wherein the second light receiving element is configured to receive the second incoming light diffusely reflected from the belt.

* * * * *